US008536435B2

(12) United States Patent
Mori

(10) Patent No.: US 8,536,435 B2
(45) Date of Patent: Sep. 17, 2013

(54) SUPPORT STRUCTURE AND PROCESS FOR PERCUSSION INSTRUMENTS

(75) Inventor: Yoshiaki Mori, Hamamatsu (JP)

(73) Assignee: Roland Corporation, Hamamatsu (JP)

( * ) Notice: Subject to any disclaimer, the term of this patent is extended or adjusted under 35 U.S.C. 154(b) by 0 days.

(21) Appl. No.: 13/326,210

(22) Filed: Dec. 14, 2011

(65) Prior Publication Data

US 2012/0266737 A1 Oct. 25, 2012

(30) Foreign Application Priority Data

Apr. 25, 2011 (JP) ..... 2011-097607
Nov. 22, 2011 (JP) ..... 2011-255143

(51) Int. Cl.
*G10D 13/02* (2006.01)

(52) U.S. Cl.
USPC ..... 84/421

(58) Field of Classification Search
USPC ..... 84/421, 453
See application file for complete search history.

(56) References Cited

U.S. PATENT DOCUMENTS 7,557,284 B2 * 7/2009 Mori et al. ..... 84/421

FOREIGN PATENT DOCUMENTS

JP 11-024660 1/1999
JP 11-212565 8/1999

* cited by examiner

*Primary Examiner* — Kimberly Lockett
(74) *Attorney, Agent, or Firm* — Foley & Lardner LLP

(57) ABSTRACT

A support structure for a percussion instrument has a support member configured to suppress the transfer of vibrations to the floor surface, and provide stability during performance. The entire percussion instrument and a portion or all of the pedal device are elastically supported above the floor, on the support member through the first vibration isolating members. Vibrations from the percussion instrument member and the pedal device are dampened by the first vibration isolating members. The first vibration isolating members are provided between the support member and the percussion instrument member, to suppress the transfer of vibrations to the floor surface, while the support member is stably supported on the floor surface.

24 Claims, 9 Drawing Sheets

(a)

(b)

(a)

(b)

SUPPORT STRUCTURE AND PROCESS FOR PERCUSSION INSTRUMENTS

CROSS-REFERENCE TO RELATED PATENT APPLICATIONS

Japan Priority Application No. 2011-097607, filed Apr. 25, 2011, and Japan Priority Application No. 2011-255143, filed Nov. 22, 2011, including the specification, drawings, claims and abstract, are incorporated herein by reference in their entirety.

FIELD OF THE INVENTION

Embodiments of the invention relate to a support structure for percussion instruments and, in particular embodiments, to a support structure which can suppress vibrations that may be transferred to a floor surface and can stably secure a percussion instrument during performance.

BACKGROUND

Some percussion instruments use a pedal device having a striking member (a beater) that is pivotally moved when stepped on by a performer. Some support structures which support percussion instruments on a floor surface have been developed for suppressing vibrations transferred to the floor surface from impacts generated when a performer steps on the pedal device.

For example, Japanese Laid-open Patent Application HEI 11-212565 describes a leg structure 8 for supporting a pad device, where the leg structure 8 has left and right front legs 81 and left and right rear legs 82. Further, the left and right rear legs 82 of the leg structure 8 include a connection rod 86 to which a foot pedal device 6 is attached in a manner such that a bottom surface of the front side of the foot pedal device is raised above the floor surface. Accordingly, the force in the direction toward the floor surface generated when a performer steps on the pedal of the foot pedal device, is distributed to all of the legs (i.e., the front legs 81 and the rear legs 82), such that noise that is transferred to the floor surface can be reduced.

Further, Japanese Laid-open Patent Application HEI 11-24660 describes a vibration isolation base. The vibration isolation base has four leg members 12, each having a setting member 22 composed of a vibration absorbing material. The vibration isolating member also has a base plate 11 that is supported on a floor surface through the leg members 12 and on which a bass drum 30 (a pad device) and a pedal 32 (a pedal device) can be mounted. Accordingly, the impact generated when a performer steps on the pedal 32 is absorbed by the vibration absorbing material of the setting members 22 of the leg members 12.

However, the leg structure 8 described in HEI 11-212565 is composed of a rigid material, such as metal, to stably support the pad device. Therefore, when the leg structure 8 vibrates at a specific frequency, the vibration transferred from the leg structure 8 to the floor surface becomes greater. An elastic material such as rubber may be attached to a portion of the leg structure 8 which is in contact with the floor surface, to suppress the noise transferred to the floor surface. However, if the leg structure 8 with such an elastic material is placed on a carpeted floor surface, the leg structure 8 becomes unstable due to elastic deformation of the elastic material. Therefore, stability at the time of performance would be deteriorated.

According to HEI 11-24660, the entire base plate 11 on which the bass drum 30 and the pedal 32 are mounted is supported by the leg members 12 that provide the vibration absorbing effect. Accordingly, when the pedal 32 is stepped on, the bass drum 30 and the pedal 32 mounted on the base plate 11 could shake in all directions (front-to-rear and right-to-left). Thus, stability at the time of performing the bass drum 30 is deteriorated.

SUMMARY OF THE DISCLOSURE

Embodiments of the invention provide a support structure for percussion instruments which can suppress vibrations transferred to the floor surface, while also providing stability at the time of performance.

A support structure according to an embodiment of the invention elastically supports a percussion instrument on a support member through first vibration isolating members in a state in which the percussion instrument is entirely lifted above the floor surface. Therefore, vibration of the percussion instrument generated when the striking surface of a pad device of the percussion instrument is beaten by the beater of the pedal device is transferred to the first vibration isolating member. The first vibration isolating members are made of an elastic material, such that the vibration transferred from the percussion instrument to the first vibration isolating members can be dampened by the vibration isolating effect of the first vibration isolating members. Therefore, vibration that is transferred from the percussion instrument to the support member can be reduced. Accordingly, vibration of the support member can be reduced and, therefore vibrations that are transferred from the support member to the floor surface can be reduced.

In addition, the pedal device is elastically supported on the support member through the first vibration isolating members in a state in which at least a portion of the pedal device is lifted above the floor surface. Accordingly, the transfer of impacts caused by the stepping motion from the pedal device to the floor surface can be reduced. The pedal device is affixed to a pedal fixing section of the percussion instrument. The percussion instrument is equipped with a link member having the pedal fixing section and a pad device to be linked to the link member. The percussion instrument is elastically supported on the support member through the first vibration isolating members. Therefore, vibration that would be transferred from the pedal device to the percussion instrument member can be damped by the vibration isolating effect of the first vibration isolating members. Accordingly, the transfer of vibration from the pedal device to the floor surface is effectively suppressed.

If the first vibration isolating members were provided between the support member and the floor surface, the first vibration isolating members would elastically deform when vibration of the support member is transferred to the first vibration isolating members, and the support member would shake due to the elastic deformation of the first vibration isolating members. As a result, the stability of the support structure of percussion instrument can be deteriorated at the time of performance.

In contrast, by providing the first vibration isolating members between the support member and the percussion instrument member, vibration of the support member is reduced by the vibration isolating effect of the first vibration isolating members, thus suppressing vibration that would be transferred to the floor surface. Furthermore, the support member can be directly placed on the floor surface, such that the support member can be stable on the floor surface. Accordingly, embodiments of the invention can effectively provide a support structure for stably supporting a percussion instrument at the time of performance.

In a further example of a support structure for percussion instruments as described above, the first vibration isolating members are disposed nearer to the pad device than to the pedal fixing section, such that the separation dimension in the height direction between the striking surface to be beaten by the beater and the first vibration isolating members can be reduced. Accordingly, it is possible to reduce an angular momentum about a virtual line through the first vibration isolating members when the striking surface of the pad device is beaten by the beater of the pedal device. Therefore, it is possible to suppress shaking movements of the percussion instrument member that are generated when the pad device is beaten.

Furthermore, because the separation dimension in the height direction between the vibration isolating members and the striking surface of the pad device can be reduced, it is possible to reduce the stress that is generated in the first vibration isolating members that support the pad device when the pad device is beaten by the beater of the pedal device. Accordingly, the service life of the first vibration isolating members can be extended.

In a further example of a support structure for percussion instruments as described above, the first vibration isolating members are disposed vertically above the pedal fixing section, as viewed in a side elevation of the percussion instrument. Therefore, when the pedal device is stepped on and the pedal fixing section is pushed down, generation of an angular momentum in the supporting member about a virtual line through the first vibration isolating members can be prevented.

In other words, if the first vibration isolating members were positioned closer to the pedal device than the pedal fixing section or were positioned further from the pedal device than the pedal fixing section, then an angular momentum about the virtual line through the first vibration isolating members would be generated in the supporting member when the pedal device is stepped on and the pedal fixing section is pushed down.

In contrast, because the first vibration isolating members are disposed vertically above the pedal fixing section, as viewed in a side elevation of the percussion instrument, generation of an angular momentum about the virtual line through the first vibration isolating members can be suppressed when the pedal device is stepped on and the pedal fixing section is pushed down. Therefore, it is possible to prevent a portion of the support member from being lifted above the floor surface, and to stabilize the support structure for percussion instrument at the time of performance.

In a further example of a support structure for percussion instruments as described above, the pedal device is mounted on a pedal mounting section, such that the pedal mounting section is supported on the support member in a state in which the pedal mounting section is entirely lifted from the floor surface. Therefore, embodiments can prevent transmission to the floor of impacts generated when a stepping motion is applied to the pedal device. Accordingly, the transfer of vibrations from the pedal device to the floor surface can be avoided.

Further, the pedal mounting section is elastically supported on the support member through second vibration isolating members, such that vibration of the pedal mounting section caused by a stepping motion on the pedal device is transferred to the second vibration isolating members. The second vibration isolating members are made of an elastic material, such that the vibration transferred to the second vibration isolating members can be dampened. Accordingly, vibrations transferred from the pedal mounting section to the support member can be reduced, and therefore vibration of the support member can be reduced. As a result, vibration to be transferred from the support member to the floor surface can be reduced.

In a further example of a support structure for percussion instruments as described above, the support member is connected to a drum stand that is capable of holding other percussion instrument members, and the support member and the percussion instrument member, in their entirety, and a part of the pedal device are supported on the drum stand in a state in which they are lifted above the floor surface. Therefore, a space on the floor is not needed for placing the support member independent of a space on the floor for the drum stand. Furthermore, the structure of the support member can be simplified, compared to the case where the support member is in contact with the floor surface, such that the manufacturing cost for the support member can be reduced.

In particular embodiments, the drum stand is equipped with a plurality of pipe members and holders to connect the plurality of pipe members together. A part of the plurality of pipe members is placed on the floor surface, and the support member is connected to the drum stand. Therefore, vibration that is transferred from the support member to the drum stand is transferred to the floor surface through the plurality of pipe members and the holders. Accordingly, a longer vibration transfer path can be provided from the percussion instrument member to the floor surface, which is effective in further reducing vibrations transferred from the percussion instrument member to the floor surface.

In a further example of a support structure for percussion instruments as described above, vibrations that are transferred from the floor surface to the support member are transferred to the first vibration isolating members, such that the vibrations can be dampened by the vibration isolation effect of the first vibration isolating members. Accordingly, as vibration to be transferred from the floor surface to the percussion instrument member can be reduced, errors in the detection by a sensor of vibrations transferred from the floor surface can be suppressed.

BRIEF DESCRIPTION OF THE DRAWINGS

FIG. 2(*b*) is a side view of the support structure for a percussion instrument as viewed in a direction IIb in FIG. 2(*a*).

FIG. 3(*b*) is a side view of the support structure for a percussion instrument as viewed in a direction IIIb in FIG. 3(*a*).

FIG. 5(*b*) is a side view of the support structure for a percussion instrument of FIG. 5(*a*), as viewed in a direction Vb in FIG. 5(*a*).

FIG. 6(*b*) is a side view of the support structure for a percussion instrument of FIG. 6(*a*) as viewed in a direction VIb in FIG. 6(*a*).

FIG. 7(*b*) is a side view of the support structure for a percussion instrument of FIG. 7(*a*) as viewed in a direction VIIb in FIG. 7(*a*).

DETAILED DESCRIPTION

Figure 1:
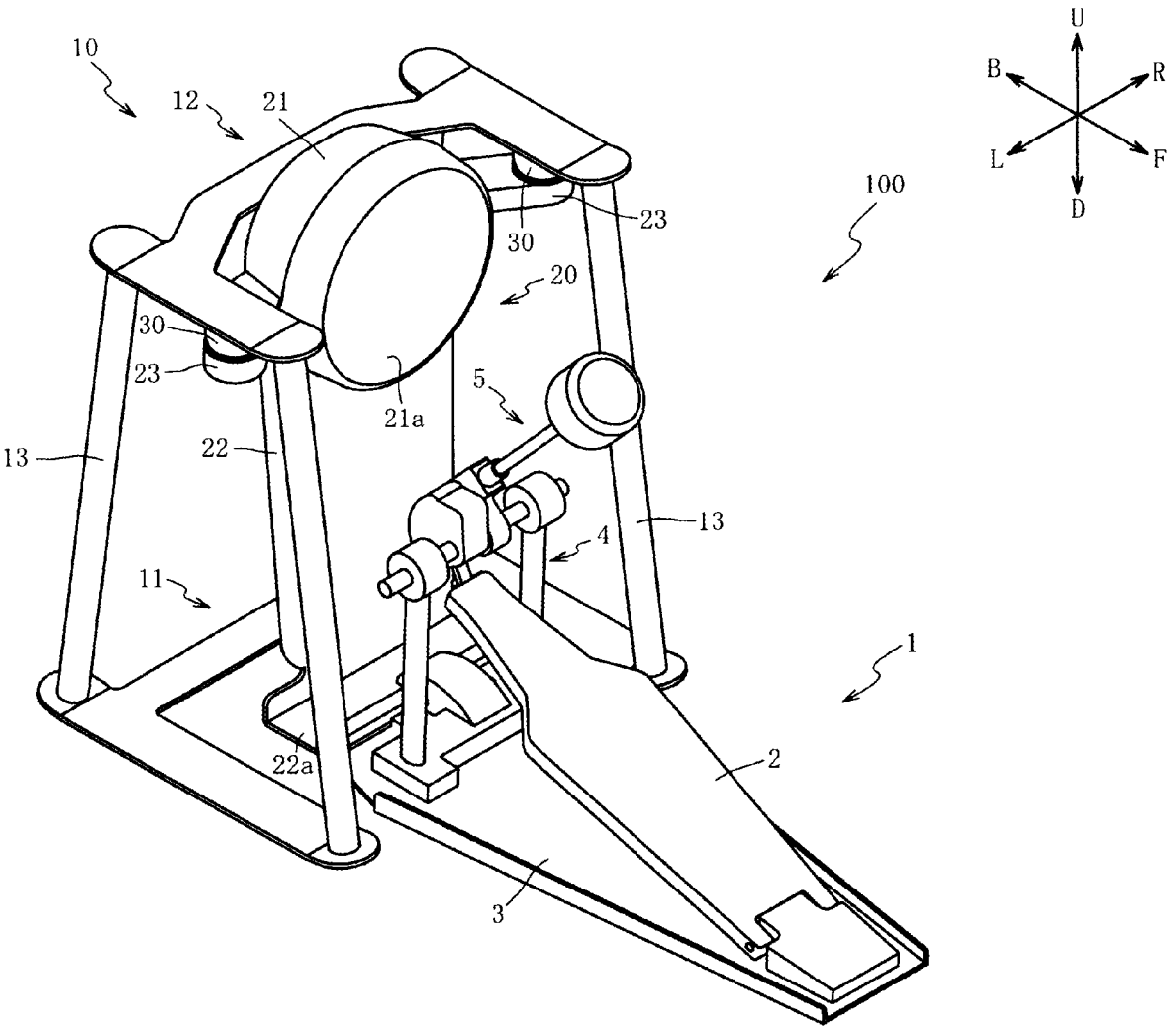
FIG. 1 is a perspective view of a support structure for a percussion instrument in accordance with an embodiment of the invention.
Figure 2:
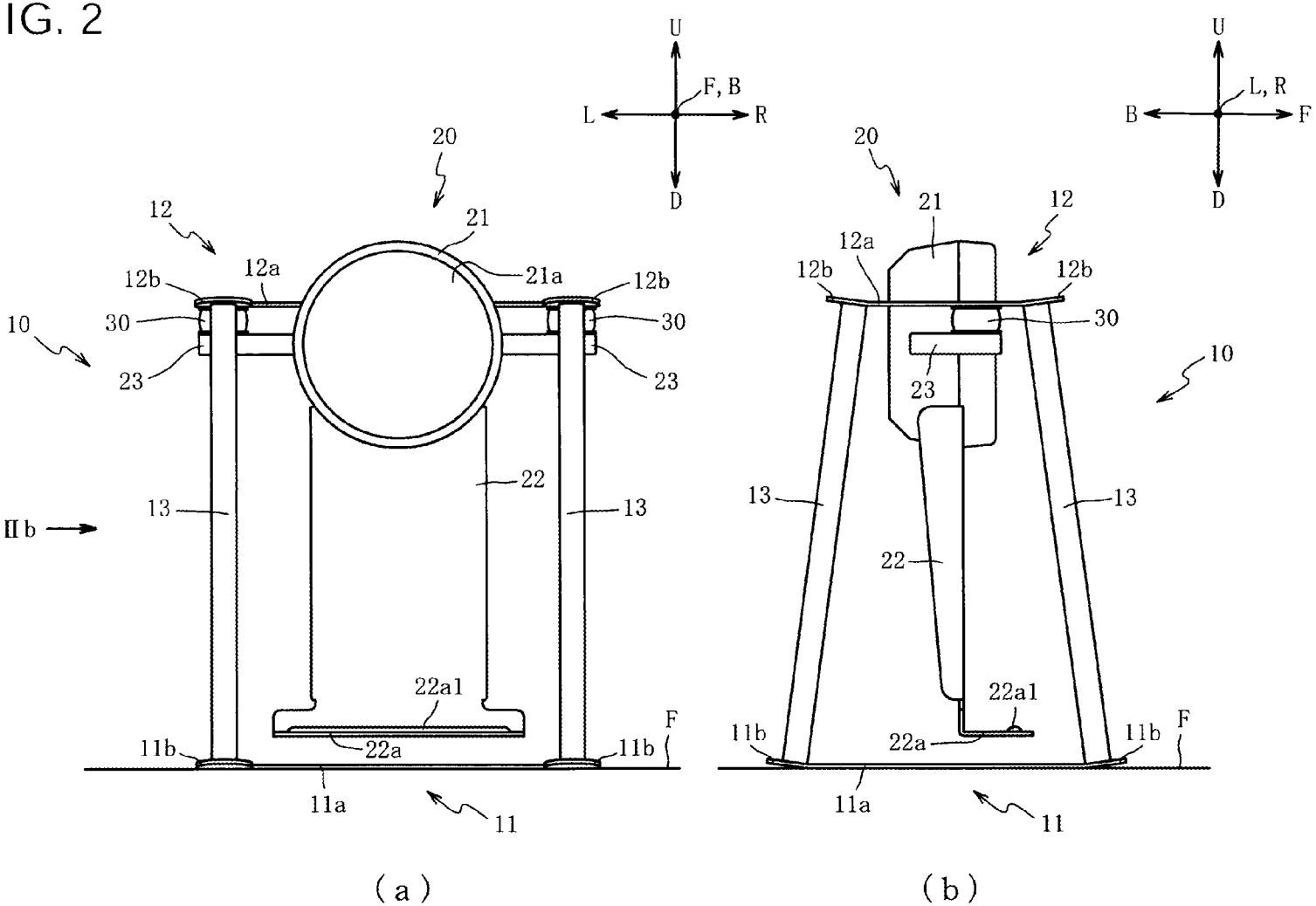
FIG. 2(*a*) is a front view of the support structure for a percussion instrument according to the embodiment of FIG. 1.
Figure 3:
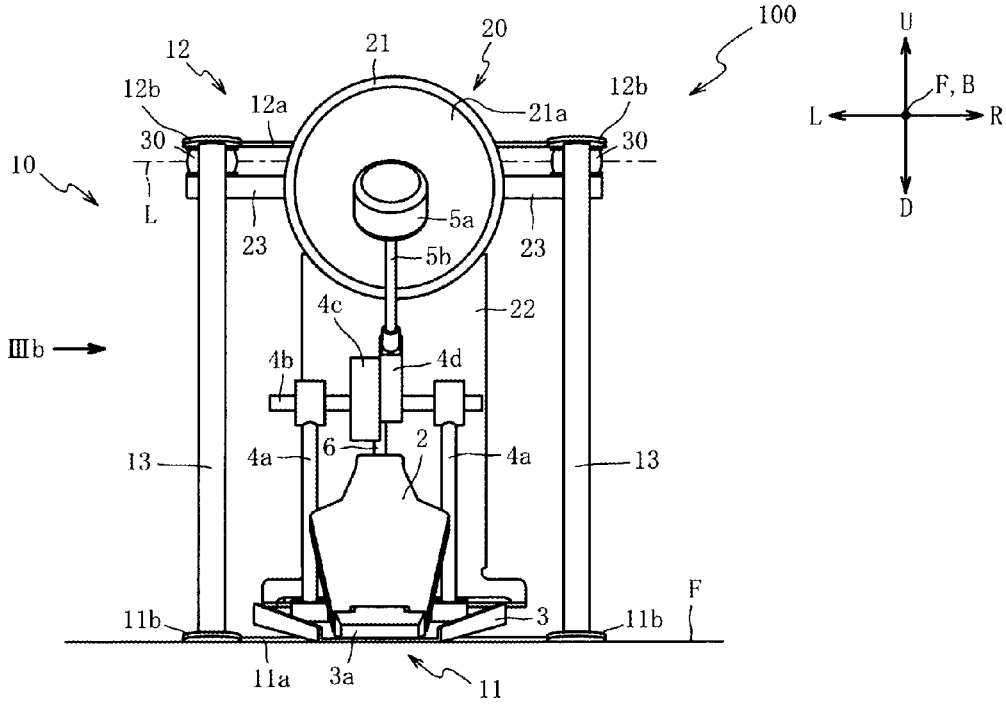
FIG. 3(*a*) is a front view of the support structure for a percussion instrument according to the embodiment of FIG. 1.
Figure 3:
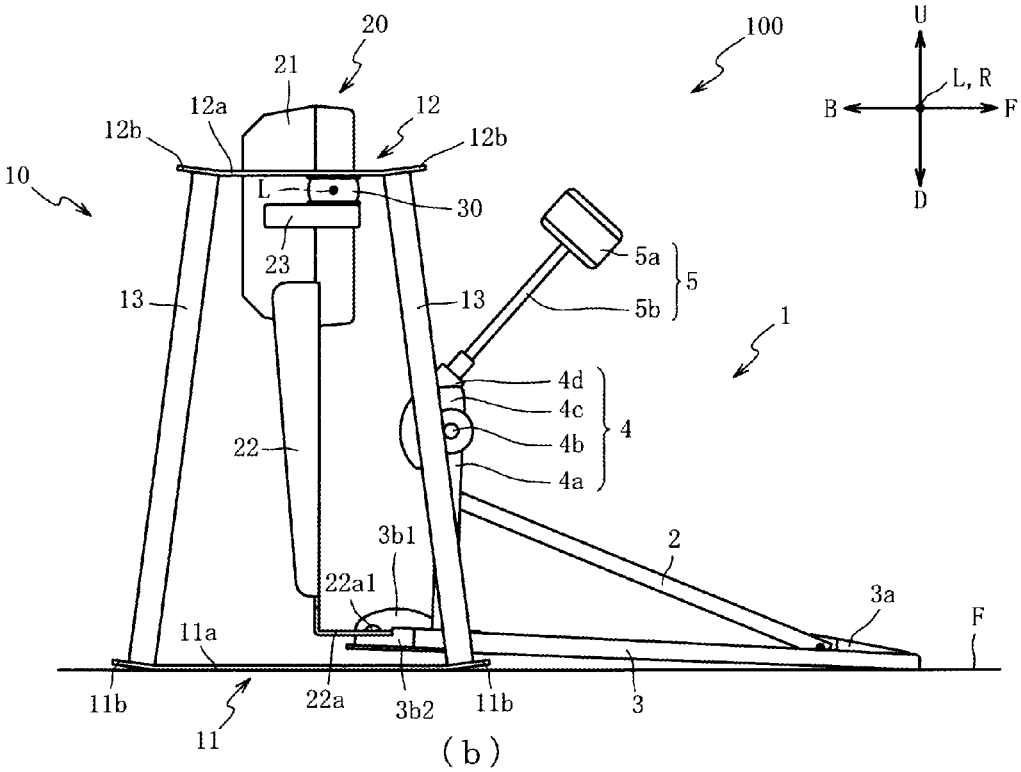

Embodiments of the invention will be described below with reference to the accompanying drawings. A configuration of a support structure 100 for a percussion instrument, in accordance with an embodiment of the invention is described with reference to FIG. 1-FIG. 3(*b*). FIG. 1 is a perspective view of the support structure 100 for a percussion instrument, and shows a state in which a pedal device 1 is affixed to the support structure 100. FIG. 2(*a*) is a front view of the support structure 100, and FIG. 2(*b*) is a side view of the support structure 100 as viewed in a direction IIb in FIG. 2(*a*). FIG. 3(*a*) is a front view of the support structure 100, and FIG. 3(*b*) is a side view of the support structure 100 as viewed in a direction Mb in FIG. 3(*a*). FIG. 3(*a*) and FIG. 3(*b*) show a state in which the pedal device 1 is affixed to the support structure 100. FIG. 1 and FIGS. 3(*a*) and 3(*b*) schematically illustrate the pedal device 1, but omit an illustration of, for example, springs for returning a pedal section 2 to the original position when the stepping motion on the pedal section 2 is released. Other figures similarly omit illustration of such components. Also, arrows U-D, L-R and F-B in FIGS. 1-3 indicate up and down directions, left and right directions, and front and back directions of the support structure 100. Those directions are similarly indicated in other figures.

As shown in FIG. 1, the support structure 100 is configured mainly with a support member 10, a percussion instrument member 20, and a first vibration isolating member 30. The support member 10 is placed on a floor surface F (see FIGS. 2(*a*) and 2(*b*)). The percussion instrument member 20 is supported on the support member 10. The first vibration isolating member 30 is provided between the percussion instrument member 20 and the support member 10. A pedal device 1 that is operated through stepping motions by a performer is affixed to the percussion instrument member 20. The percussion instrument member 20 is performed through the stepping operation of the pedal device 1. Also, the percussion instrument member 20 is supported on the support member 10 in a state in which it is lifted above the floor surface F. The pedal device 1 is supported on the percussion instrument member 20 in a state in which a portion of the pedal device 1 is lifted above the floor surface F.

As shown in FIG. 2(*a*) and FIG. 2(*b*), the support member 10 is formed from metal members that support the percussion instrument member 20 on the floor surface F in a state in which the percussion instrument member 20 is lifted above the floor surface F. The support member 10 includes a lower plate 11, an upper plate 12 and leg sections 13. The lower plate 11 is a plate-like member that is placed on the floor surface F. The upper plate 12 is a plate-like member provided above the lower plate 11. The leg sections 13 are rod-like members that connect the upper plate 12 and the lower plate 11.

The lower plate 11 includes a lower base section 11*a* and four lower connection sections 11*b*. The percussion instrument member 20 is mounted on the lower base section 11*a*. The lower base section 11*a* is formed in a plate having a channel shape that opens on the front side. The four lower connection sections 11*b* extend outwardly, in the front-to-back direction, from corner sections of the lower base section 11*a*. Furthermore, the bottom surface of the lower base section 11*a* is placed on the floor surface F, and the lower connection sections 11*b* are tilted upwardly with respect to the lower base section 11*a*.

The upper plate 12 supports the percussion instrument member 20 through the first vibration isolating member 30. The upper plate 12 includes an upper base section 12*a* and four upper connection sections 12*b*. The upper base section 12*a* is formed in a plate having a channel shape that opens on the front side. The four upper connection sections 12*b* extend outwardly, in the front-to-back direction, from corner sections of the upper base section 12*a*. The upper base section 12*a* is disposed in parallel with the lower base section 11*a* and has a dimension in the left-to-right direction that is similar to the left-to-right direction dimension of the lower base section 11*a*. The upper base section 12*a* has a dimension in the front-to-back direction that is smaller than the front-to-back direction dimension of the lower base section 11*a*. Also, the upper connection sections 12*b* are tilted upwardly with respect to the upper base section 12*a*. The tilt angle of the upper connection sections 12*b* is about equal to the tilt angle of the lower connection section 11*b* with respect to the lower base section 11*a*.

The leg sections 13 set the upper plate 12 at a predetermined height above the floor surface F. The embodiment illustrated in FIGS. 1-4 has four leg sections 13 arranged at positions corresponding to the lower connection sections 11*b* of the lower plate 11 and the upper connection sections 12*b* of the upper plate 12. Each leg section 13 has a lower end connected to a respective lower connection section 11*b* and an upper end connected to a respective upper connection section 12*b*.

The lower ends of the leg sections 13 are connected to the lower plate 11, and the lower base section 11*a* of the lower plate 11 is placed on the floor surface F. Accordingly, as compared to a case where lower ends of the leg sections 13 are placed directly on the floor surface F, a wider contact area of the support member 10 can be supported on the floor surface F. Also, the upper base section 12*a* of the upper plate 12 is formed with a smaller dimension in the front-to-back direction than that of the lower base section 11*a* of the lower plate 11. Therefore, the contact area of the lower plate 11 with respect to the floor surface F is made larger, for stably supporting the support structure 100 during performance, while the upper plate 12 can be made smaller such that the stand 10 can be made lighter, and the cost of components can be reduced.

The bottom surface of the lower base section 11*a* of the lower plate 11 may be covered by an elastic material, such as a rubber material, for contacting the floor surface F. Accordingly, the elastic material can help prevent scratching of the floor surface F. The support structure 100 uses the first vibration isolating member 30 to reduce vibrations of the percussion instrument member 20, such that it is not necessary to reduce vibration of the percussion instrument member 20 by the rubber-like elastic material covering the lower surface of the lower plate 11. Therefore, in particular embodiments, the rubber-like elastic material covering the lower surface of the lower plate 11 has a smaller elasticity than that of the first vibration isolating member 30. If the rubber-like elastic material covering the lower surface of the lower plate 11 has a high level of elasticity, the support member 10 might shake in all directions and deteriorate the stability of the support structure 100. However, by using a rubber-like elastic material having a relatively low level of elasticity for covering the lower surface of the lower plate 11, the floor surface F can be protected from being scratched, while the stability of the support structure for percussion instrument 100 can be maintained.

The percussion instrument member 20 includes a pad device 21, a pedal connection member 22, and a pair of vibration isolating connection members 23. The pad device 21 has a striking surface 21*a* that is beaten, using the pedal device 1 (see FIG. 1). The pedal connection member 22 is connected to the pad device 21 and extends downward. The vibration isolating connection members 23 are connected to the pad device 21 and extend outwardly in a horizontal direction to the left and right sides.

The pad device 21 may be an electronic percussion instrument that is provided with a sensor (not shown) for detecting vibrations of the striking surface 21*a*. When the striking surface 21*a* is beaten, the sensor detects vibrations of the striking surface 21*a*. A detection signal corresponding to detected vibrations is provided by the sensor and is transmitted to a sound source. The sound source is configured to generate musical sound according to the detected beating action. The generated musical sound is emanated from a speaker system through an amplifier.

The pedal connection member 22 connects the pad device 21 and the pedal device 1 together. The pedal connection member 22 may be composed of metal material having a predetermined rigidity. The pedal connection member 22 has a pedal fixing section 22*a*. The pedal fixing section 22*a* is formed by bending a lower end portion of the pedal connection member 22 toward the front side (the side that the striking surface 21*a* faces). The pedal device 1 is connected to the pedal fixing section 22*a*. A protruding section 22*a*1 extends in the left-to-right direction and protrudes from the upper surface of the pedal fixing section 22*a*. The protruding section 22*a*1 enhances the stiffness of the pedal fixing section 22*a* and enhances the holding force for securing the pedal device 1.

The vibration isolating connection members 23 connect the pad device 21 and the support member 10 together. Each of the vibration isolating connection members 23 is composed of a metal material having a predetermined rigidity. Also, each of the vibration isolating connection members 23 is extended to the lower surface of the upper base section 12, on each of the left and right sides of the upper base section 12. The extended tip portions of the vibration isolating connection members 23 are located, generally, at the same position in the front-to-back direction as the pedal fixing section 22*a*.

Each first vibration isolating member 30 includes one or more members for attenuating vibration of the percussion instrument member 20. A pair of first vibration isolating members 30 is provided on the percussion instrument member 20, with one vibration isolating member 30 on the left side and one vibration isolating member 30 on the right side, and both vibration isolating members 30 diagonally above the pedal fixing section 22*a* of the percussion instrument member 20. The first vibration isolating members 30 are provided symmetrically in a pair and are arranged at positions that are equidistant from the pedal fixing section 22*a*. Each of the first vibration isolating members 30 is formed in a cylindrical shape from a rubber-like elastic material. The upper end face of each of the first vibration isolating members 30 is attached to the lower surface side of the upper base section 12*a* of the support member 10. Further, the lower end face of each of the first vibration isolating members 30 is attached to the upper surface side of outer end portions of the pair of vibration isolating connection members 23 extending in the left-to-right direction from the percussion instrument member 20. Accordingly, the first vibration isolating members 30 are located generally at the same position in the front-to-back direction as that of the pedal fixing section 22. Also, the first vibration isolating members 30 are located generally at the same positions in the left-to-right direction as those of the left and right end sections of the lower base section 11 and the upper base section 12 of the support member 10. Furthermore, the first vibration isolating members 30 are located generally at the same position in the height direction as the position of the pad device 21.

If the pair of first vibration isolating members 30 were attached closer in the horizontal direction to the pad device 21, not only would a force be applied downwardly to the pair of first vibration isolating members 30, when elastically supporting the percussion instrument member 20, but a rotational force would also likely be applied about an axis in the front-to-back direction of the percussion instrument member 20. In this case, in order to stably retain the percussion instrument member 20 when the pedal device 1 is stepped on, the pair of first vibration isolating members 30 would need to be composed of a rubber-like elastic material having a relatively small elasticity such that the amount of elastic deformation of the pair of first vibration isolating members 30 is relatively small when the pedal device 1 is stepped on. As a result, the vibration isolation effect of the pair of first vibration isolating members 30 is diminished.

In contrast, as the pair of first vibration isolating members 30 are attached to the tip portions of the pair of vibration isolating connection members 23 that are connected to the pad device 21 and are extended outwardly to the left and right directions, a relatively large separation distance in the horizontal direction can be provided between the pad device 21 and each of the first vibration isolating members 30. Therefore, a rotational force that would be applied about an axis in the front-to-back direction of the percussion instrument member 20 can be suppressed, while elastically supporting the percussion instrument member 20. In other words, it is sufficient if the pair of first vibration isolating members 30 has an elasticity enough to deform elastically with a force applied downwardly, yet prevent the percussion instrument member 20 from contacting the floor surface F. Therefore, even when the pair of first vibration isolating members 30 is composed of a rubber-like elastic material having a relatively large elasticity, the percussion instrument member 20 can be stably supported, and the vibration isolating effect of the first vibration isolating members 30 can be obtained.

According to example embodiments of the present embodiment, the first vibration isolating members 30 are each composed of a rubber-like elastic material. In other embodiments, each first vibration isolating member 30 may be formed from other suitable material or device that suppresses or attenuates vibration, such as, a spring, a damper or the like.

As shown in FIG. 3(*a*) and FIG. 3(*b*), the pedal device 1 is configured to beat the striking surface 21*a* of the percussion instrument member 20 in response to stepping motions by the performer. The pedal device 1 includes a pedal section 2, a pedal base section 3, an upstanding section 4, and a beating member 5. The pedal section 2 is configured to be stepped on by the performer. The pedal base section 3 supports the pedal section 2 for pivotal, rotational motion. The upstanding section 4 is supported upright on the pedal base section 3. The beating member 5 is supported on the upstanding section 4 for pivotal, rotational motion.

The pedal section 2 is pivotally supported on the pedal base section 3, on one side of the longitudinal dimension of the pedal section 2 (on the right side in FIG. 3(*b*)). The pedal section 2 is connected to the upstanding section 4, through a band-like belt 6, on the other side of the longitudinal dimension of the pedal 2 (on the left side in FIG. 3(*b*)).

The pedal base section 3 includes a pedal axial support section 3*b*, and a pair of upper and lower pedal gripping and holding sections 3*b*1 and 3*b*2. The pedal axial support section 3*a* is provided on one side in the longitudinal dimension of the pedal base section 3 (on the right side in FIG. 3(*b*)). The upper and lower gripping and holding sections 3*b*1 and 3*b*2 are provided on the other side in the longitudinal dimension of the pedal base section 3 (on the left side in FIG. 3(*b*)). The pedal axial support section 3*a* supports the pedal section 2 for pivotal, rotational motion, on the one side in the longitudinal dimension of the pedal base section 3. The pair of pedal gripping and holding sections 3*b*1 and 3*b*2 grips and holds the pedal device 1 on the pedal fixing section 22*a* of the percussion instrument member 20 in a freely detachable manner. Furthermore, the upper pedal gripping and holding section 3*b*1 is moveable up and down with respect to the lower pedal gripping and holding section 3*b*2. When the pair of upper and lower pedal gripping and holding sections 3*b*1 and 3*b*2 grips, holds and fixes the pedal fixing section 22*a*, the pedal device 1 is affixed to the percussion instrument member 20.

The upstanding section 4 includes a pair of column members 4*a*, a rotation shaft 4*b*, a belt connection section 4*c* and a beating member attachment section 4*d*. The column members 4*a* are supported upright on the pedal base section 3 on the other side in the longitudinal dimension of the pedal base section 3 with respect to the side at which the pedal axial support section 3*a* is located. The rotation shaft 4*b* is rotatably supported on the pair of column members 4*a*. The belt connection section 4*c* is fixedly attached to the outer peripheral surface of the rotation shaft 4*b*, and is connected to a belt 6. The beating member attachment section 4*d* is fixedly attached to the rotation shaft 4*b*. The beating member 5 is fixedly attached to the beating member attachment section 4*d* in a freely detachable manner.

The beating member 5 is configured to beat the striking surface 21*a* of the pad device 21. The beating member 5 includes a head member 5*a* and a rod member 5*b*. The head member 5*a* is for beating the striking surface 21*a*. The rod member 5*b* has one end that is attached to the head member 5*a*, and has another end that is attached to the beating member attachment section 4*d* of the upstanding section 4.

Figure 4:
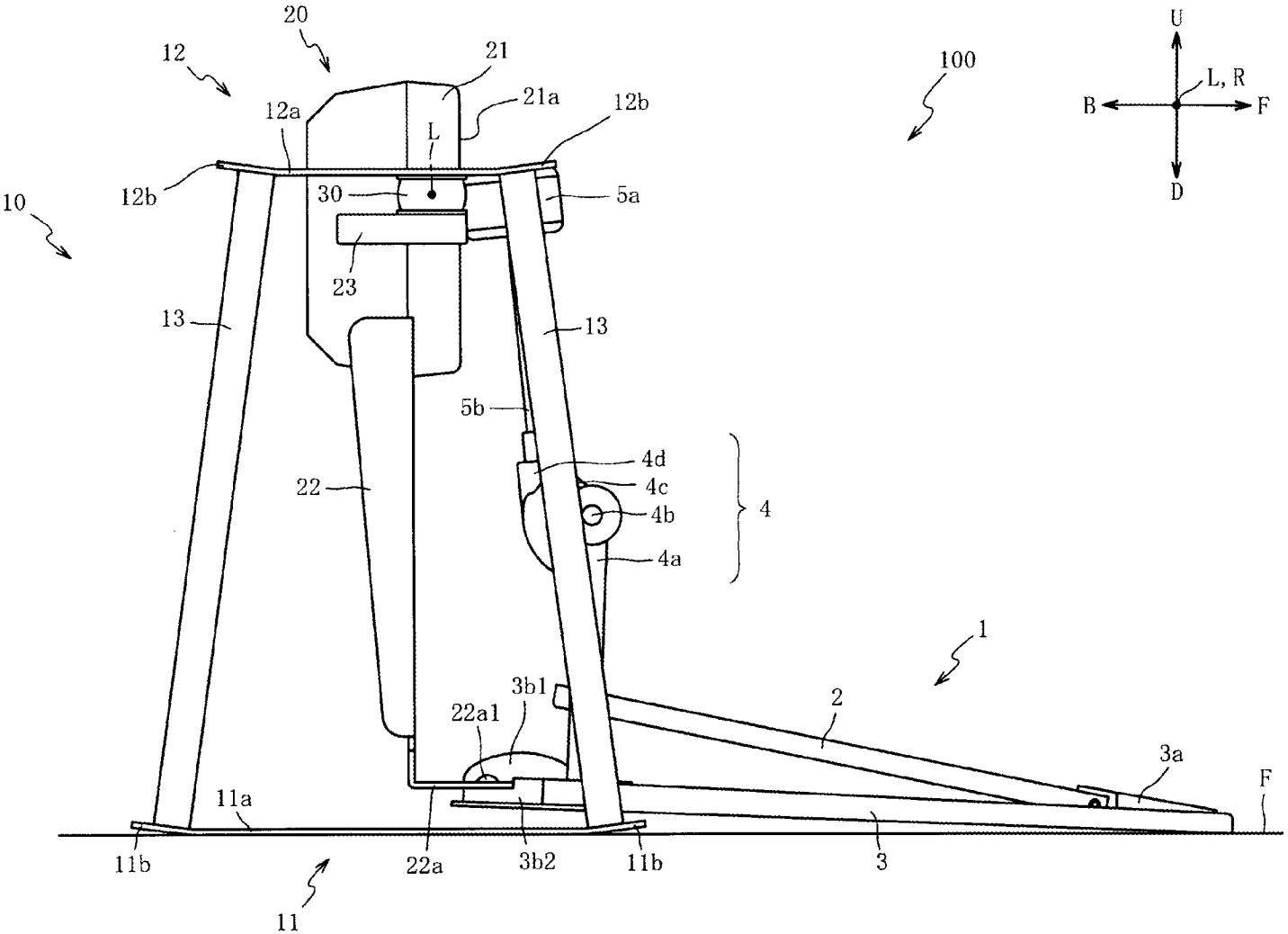
FIG. 4 is a further side view of the support structure for a percussion instrument according to the embodiment of FIG. 3(*b*).

Referring to FIG. 4, the support structure 100 for the percussion instrument member 2 is shown at the time of performance FIG. 4 shows a side view of the percussion instrument member 20, at a state in which the pedal section 2 of the pedal device 1 is being stepped on, and the beating member 5 is striking the striking surface 21*a* of the pad device.

As shown in FIG. 4, when the pedal section 2 of the pedal device 1 is stepped on by the performer, the raised side of the pedal section 2 is pushed down, and the belt 6 (see FIG. 3(*a*)) is pulled in a downward direction. As a result, the belt connection section 4*c* of the upstanding section 4 to which the belt 6 is connected is rotationally moved in a first direction (in a counterclockwise direction in FIG. 4). As the belt connection section 4*c* rotationally moves in the first direction, the rotation shaft 4*b* that is affixed to the belt connection section 4*c* and the beating member attachment section 4*d* that is affixed to the rotation shaft 4*b* rotationally move in the first direction. As a result, the head member S a of the beating member 5 strikes the striking surface 21*a* of the pad device 21. Further, when the pedal section 2 is released after being stepped on, one end of the pedal section 2 elevates, and the rotation shaft 4*b*, the belt connection section 4*c*, the beating member attachment section 4*d* and the beating member 5 rotationally move in a second direction (the clockwise direction in FIG. 4). In other words, the pedal device 1 returns to the state before the pedal section 2 is stepped on.

The percussion instrument member 20 is elastically supported on the support member 10 through the pair of first vibration isolating members 30 in a state in which the entire percussion instrument member 20 is lifted above the floor surface F. Therefore, when the pedal section 2 is stepped on, vibrations of the percussion instrument member 20 generated when the striking surface 21*a* of the pad device 21 is beaten by the beating member 5 are transferred to the first vibration isolating members 30. The first vibration isolating members 30 are composed of a rubber-like elastic material, such that the vibrations transferred from the percussion instrument member 20 to the first vibration isolating members 30 can be dampened by the first vibration isolating members 30. Therefore, vibrations transferred from the percussion instrument member 20 to the support member 10 can be reduced. Accordingly, vibrations transferred from the support member 10 to the floor surface F can be reduced.

Further, the pedal device 1 is elastically supported on the support member 10 through the first vibration isolating members 30 in a state in which a portion of the pedal device 1 is lifted above the floor surface F. Therefore, the transfer of impacts from the pedal device 1 to the floor surface F caused by a stepping operation on the pedal section 2 can be reduced. Also, the pedal device 1 is affixed to the pedal fixing section 22*a*, and the pedal connection member 22 having the pedal fixing section 22*a* and the pad device 21 is elastically supported on the support member 10 through the first vibration isolating members 30. Therefore, vibrations that are transferred from the pedal device 1 to the percussion instrument member 20 can be dampened by the vibration isolating effect of the first vibration isolating members 30. Accordingly, the transfer of vibrations from the pedal device 1 to the floor surface F can be suppressed.

In addition, vibrations that are transferred from the floor surface F and the pedal device 1 to the support member 10 can be dampened by the vibration isolating effect of the first vibration isolating members 30. Therefore, it is possible to reduce the transfer of vibrations from the floor surface F and the pedal device 1 to a sensor provided within the pad device 21. In other words, error detection by the sensor of vibrations transferred from the floor surface F and the pedal device 1 can be suppressed.

If the first vibration isolating members 30 were provided between the support member 10 and the floor surface F, the first vibration isolating members 30 would elastically deform when vibration of the support member 10 is transferred to the first vibration isolating members 30, and the support member 10 would shake due to the elastic deformation of the first vibration isolating members 30. In other words, the stability of the support structure 100 could be deteriorated during performance.

In contrast, by providing the first vibration isolating members 30 between the support member 10 and the percussion instrument member 20, vibration of the support member 10 is reduced by the vibration isolating effect of the first vibration isolating members 30, such that vibrations that are transferred to the floor surface F can be suppressed, while the support member 10 can be directly placed on the floor surface F and remain stable. Accordingly, the stability of the support structure 100 at the time of performance can be maintained.

Further, if the first vibration isolating members 30 were provided between the pad device 21 of the percussion instrument member 20 and the pedal device 1, the relative position of the pad device 21 and the pedal device 1 would change depending on the elastic deformation of the first vibration isolating members 30 produced by the stepping motion on the pedal section 2, from the time when the stepping operation is started until the time when the beating member 5 strikes the striking surface 21*a*. In this case, the amount of elastic deformation of the first vibration isolating members 30 changes with the force of the stepping motion and the speed of the stepping motion on the pedal section 2. Therefore, the amount of change of the relative position of the pad device 21 and the pedal device 1 is changed according to the force of the stepping motion and the speed of the stepping motion on the pedal section 2. In other words, depending on the amount of change of the relative position of the pad device 21 and the pedal device 1, the stepping amount necessary for pivotally moving the beating member 5 to beat the striking surface 21*a* changes. As a result, the time elapsing from the moment when the performer starts stepping on the pedal section 2 until the moment when the beating member 5 strikes the striking surface 21*a* changes according to the force of the stepping motion and the speed of stepping motion. In that regard, it can become difficult for the performer to beat the striking surface 21*a*, stably, at proper timings.

In contrast, in accordance with embodiments of the present invention, the first vibration isolating members 30 are provided between the support member 10 and the percussion instrument member 20, while the pad device 21 and the pedal device 1 are coupled together by the pedal connection member 22 that is made of metal and has a predetermined stiffness. Therefore, during the period from the time when the stepping operation on the pedal section 2 is started until the time when the beating member 5 strikes the striking surface 21*a*, any changes in the relative position between the pedal device 1 affixed to the pedal fixing section 22*a* and the pad device 21 caused by elastic deformation of the first vibration isolating members 30 can be avoided. Accordingly, regardless of the force of the stepping motion and the speed of the stepping motion on the pedal section 2, it is possible to suppress changes in the period of time elapsing from the moment when the performer starts stepping on the pedal section 2 until the moment when the beating member 5 strikes the striking surface 21*a*. Therefore, the performer may beat the striking surface 21*a* stably, at proper timings.

Furthermore, the first vibration isolating members 30 are provided symmetrically with respect to the pedal fixing section 22*a*, at positions equidistant from the pedal fixing section 22*a*. Therefore, as the pedal fixing section 22*a* is pushed down when the pedal section 2 is stepped on, an equal load can be applied to each of the first vibration isolating members 30. Accordingly, it is possible to avoid applying a greater load on one of the vibration isolating members 30 relative to the other vibration isolating members 30 and, thus, reduce the chance of the percussion instrument member 20 and the pedal device 1 becoming tilted to the left or the right during a stepping operation on the pedal section 2. Further, as a result, it is possible to avoid lifting of the left side or the right side of the support member 10 above the floor surface F. Accordingly, the stability of the support structure 100 at the time of performance can be maintained. Furthermore, even if the head member 5*a* of the beating member 5 strikes the striking surface 21*a* at a position offset from the center of the striking surface, it is possible to prevent the pad device 21 from swaying from side to side.

Also, the first vibration isolating members 30 are arranged, generally, at the same height as the height of the pad device 21. Accordingly, it is possible to reduce an angular momentum about a virtual linear line L through the pair of first vibration isolating members 30 that, otherwise, would be generated by an impact occurring when the beating member 5 strikes the striking surface 21*a*. Therefore, it is possible to suppress swaying of the percussion instrument member 20 which, otherwise, may be caused when the pad device 21 is beaten.

Furthermore, as the pair of first vibration isolating members 30 and the pad device 21 are disposed generally at the same height, stress that is applied to the first vibration isolating members 30 can be reduced when the pad device 21 is beaten by the beating member 5. Therefore, the first vibration isolating members 30 can have a longer service life.

Also, the pair of first vibration isolating members 30 is positioned generally at the same location as that of the pedal fixing section 22*a* in the front-to-back direction. In other words, in a side view of the percussion instrument member 20, the pair of first vibration isolating members 30 is located vertically above the pedal fixing section 22*a*. Therefore, when the pedal section 2 is stepped on and the pedal fixing section 22*a* is pushed down, angular force on the support member 10 about the virtual linear line L can be reduced. In contrast, if the pair of first vibration isolating members 30 were located in the front or in the back of the pedal fixing section 22*a*, an angular momentum is generated in the support member 10 about the virtual linear line L when the pedal section 2 is stepped on, and the pedal fixing section 22*a* is pushed down.

By positioning the pair of first vibration isolating members 30 vertically above the pedal fixing section 22*a*, angular force on the support member 10 about the virtual line L is suppressed, when the pedal section 2 is stepped on, and the pedal fixing section 22*a* is pushed down. Therefore, it is possible to inhibit lifting of the front or the back end of the support member 10 above the floor surface F to enhance the stability of the support structure 100 during performance.

Furthermore, the percussion instrument member 20 is elastically supported through the pair of first vibration isolating members 30. Therefore, due to the elastic deformation of the first vibration isolating members 30, the percussion instrument member 20 can be slightly rotationally moved in the front-to-back direction with respect to the support member 10. Therefore, when the pedal device 1 is affixed to the pedal fixing section 22*a*, the first vibration isolating members 30 can be elastically deformed so as to absorb differences in the shape of the fixing portion provided on the pedal device 1. Accordingly, the rear end of the pedal base section 3 can be brought in contact with the floor surface F, and the front end of the pedal base section 3 can be lifted above the floor surface F. Therefore, the support structure 100 can be used with various pedal devices 1 having different arrangement positions and fixing angles, for greater versatility.

Figure 5:
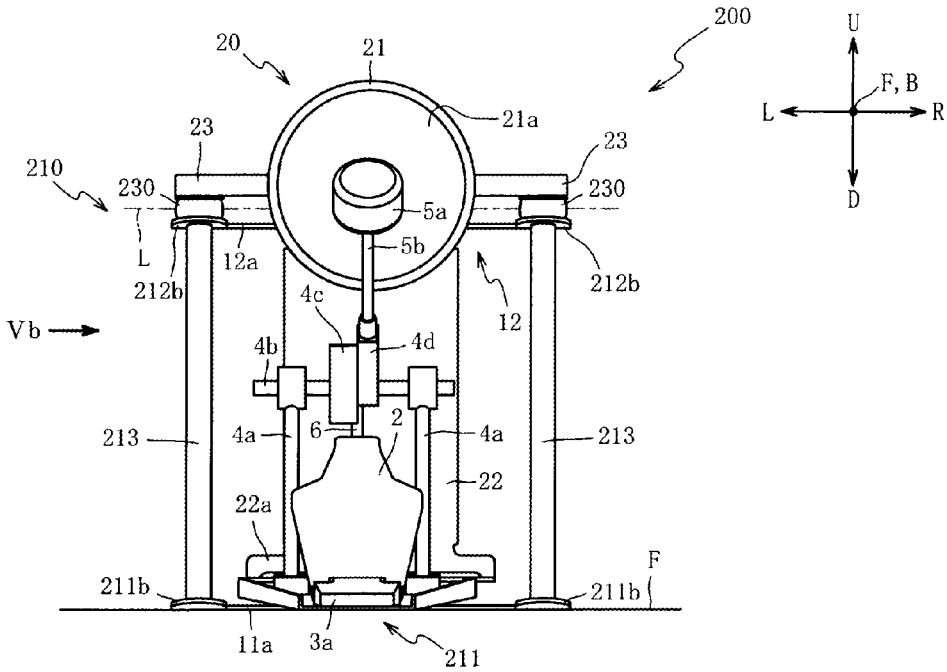
FIG. 5(*a*) is a front view of a support structure for a percussion instrument in accordance with another embodiment.
Figure 5:
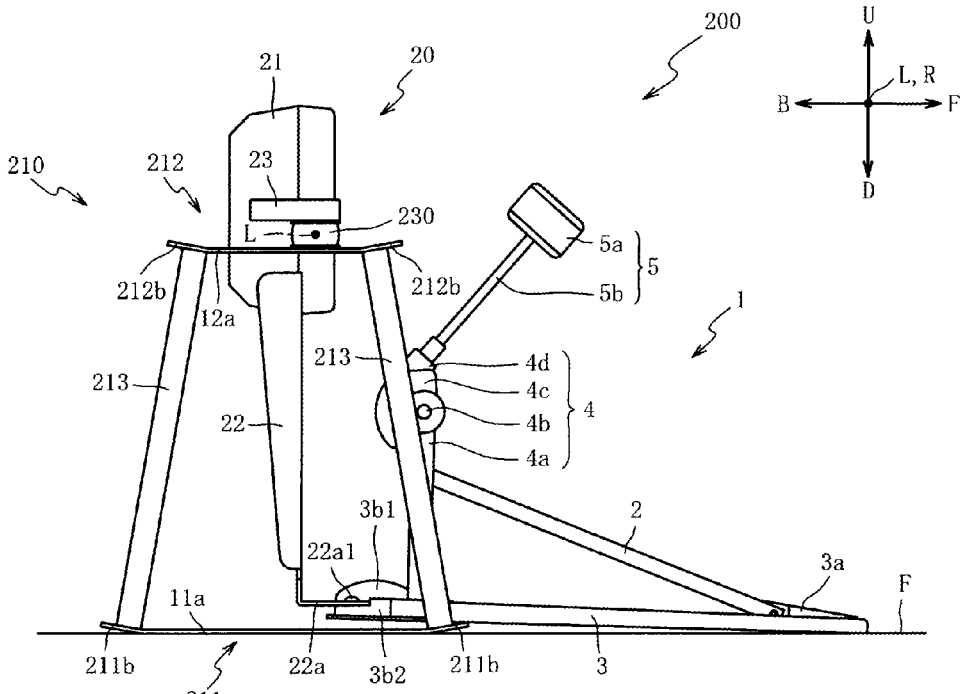

Another embodiment is described with reference to FIGS. 5(*a*) and 5(*b*). In the embodiment described above, the upper end face of each of the first vibration isolating members 30 is attached to the support member 10 and the lower end face of each of the first vibration isolating members 30 is attached to the percussion instrument member 20. However, in accordance with the embodiment in FIGS. 5(*a*) and 5(*b*), the upper end face of each of the first vibration isolating members 230 is attached to the percussion instrument member 20 and the lower end face of each of the first vibration isolating members 230 is attached to the support member 10. Components that are identical to components of the previously-described embodiment are provided with the same reference numbers, and the above descriptions of those components are incorporated by reference. FIG. 5(*a*) is a front view of a support structure 200 for a percussion instrument in accordance with the other embodiment. FIG. 5(*b*) is a side view of the support structure 200 for a percussion instrument, as viewed in a direction Vb in FIG. 5(*a*).

As shown in FIG. 5(*a*) and FIG. 5(*b*), the support structure 200 includes a support member 210, a percussion instrument member 20, and first vibration isolating members 230. The support member 210 is placed on the floor surface F. The percussion instrument member 20 is supported on the support member 210. The first vibration isolating members 230 are provided between the percussion instrument member 20 and the support member 210.

The support member 210 includes a lower plate 211, an upper plate 212, and leg sections 213. The lower plate 211 is placed on the floor surface F. The upper plate 212 is provided above the lower plate 211. The leg sections 213 are rod-like members that connect the upper plate 212 and the lower plate 211.

The lower plate 211 has a lower base section 11*a* and lower connection sections 211*b*. The lower connection sections 211*b* extend outward, in the front-to-back direction, from four corner sections of the lower base section 11*a*. Also, the upper plate 212 has an upper base section 12*a* and upper connection sections 212*b*. The upper connection sections 212*b* extend outward, in the front-to-back direction, from four corner sections of the upper base section 12*a*. The upper base section 12*a* is arranged at a position where end sections, in the left-to-right direction, of its upper surface are opposite the lower surface of the vibration isolating connection members 23 at end sections.

It is noted that the lower plate 211 has the same configuration as that of the lower plate 11 in accordance with the embodiment described above, except with respect to the tilt angle of the lower connection section 211*b* relative to the lower base section 211*a*. Also, the upper plate 212 has the same configuration as that of the upper plate 12 in accordance with the embodiment described above, except with respect to the tilt angle of the upper connection section 212*b* relative to the upper base section 12*a*. Further, the leg sections 213 have the same configuration as that of the leg sections 13 in accordance with the embodiment described above, except with respect to the dimension in their longitudinal direction.

The first vibration isolating members 230 are configured to attenuate vibrations of the percussion instrument member 20. The first vibration isolating members 230 are arranged symmetrically with respect to, and diagonally above the pedal fixing section 22*a* of the percussion instrument member 20. The first vibration isolating members 230 are arranged symmetrically, at positions equidistant from the pedal fixing section 22*a*. Each of the first vibration isolating members 230 is formed in a cylindrical shape from a rubber-like elastic material. The upper end face of each of the first vibration isolating members 230 is attached to the lower surface side of end portions of the vibration isolating connection members 23 extending from the percussion instrument member 20. Further, the lower end face of each of the first vibration isolating members 230 is attached to the upper surface side of the upper base section 12*a* of the support member 210. Also, the pair of first vibration isolating members 230 is located generally at the same position in the front-to-back direction as that of the pedal fixing section 22. Also, the pair of first vibration isolating members 230 is located generally at the same positions in the left-to-right direction as those of the left and right end sections of the lower base section 11*a* and the upper base section 12*a* of the support member 210. Furthermore, the pair of first vibration isolating members 230 is located generally at the same height as that of the pad device 21.

In accordance with the embodiment of FIGS. 5(*a*) and 5(*b*), the percussion instrument member 20 is elastically supported on the support member 10 through the pair of first vibration isolating members 230 in a state in which the entire percussion instrument member 20 is lifted above the floor surface F. Therefore, vibrations of the percussion instrument member 20 that are generated when the striking surface 21*a* of the pad device 21 is beaten by the beating member 5 of the pedal device 1 are transferred to the first vibration isolating members 230. Therefore, vibrations transferred from the percussion instrument member 20 to the first vibration isolating members 230 can be dampened by the vibration isolation effect of the first vibration isolating members 230. Therefore, as vibrations that are transferred from the percussion instrument member 20 to the support member 210 can be reduced, vibrations of the support member 210 can be reduced. As a result, vibrations that are transferred from the support member 210 to the floor surface F can be reduced.

Figure 6:
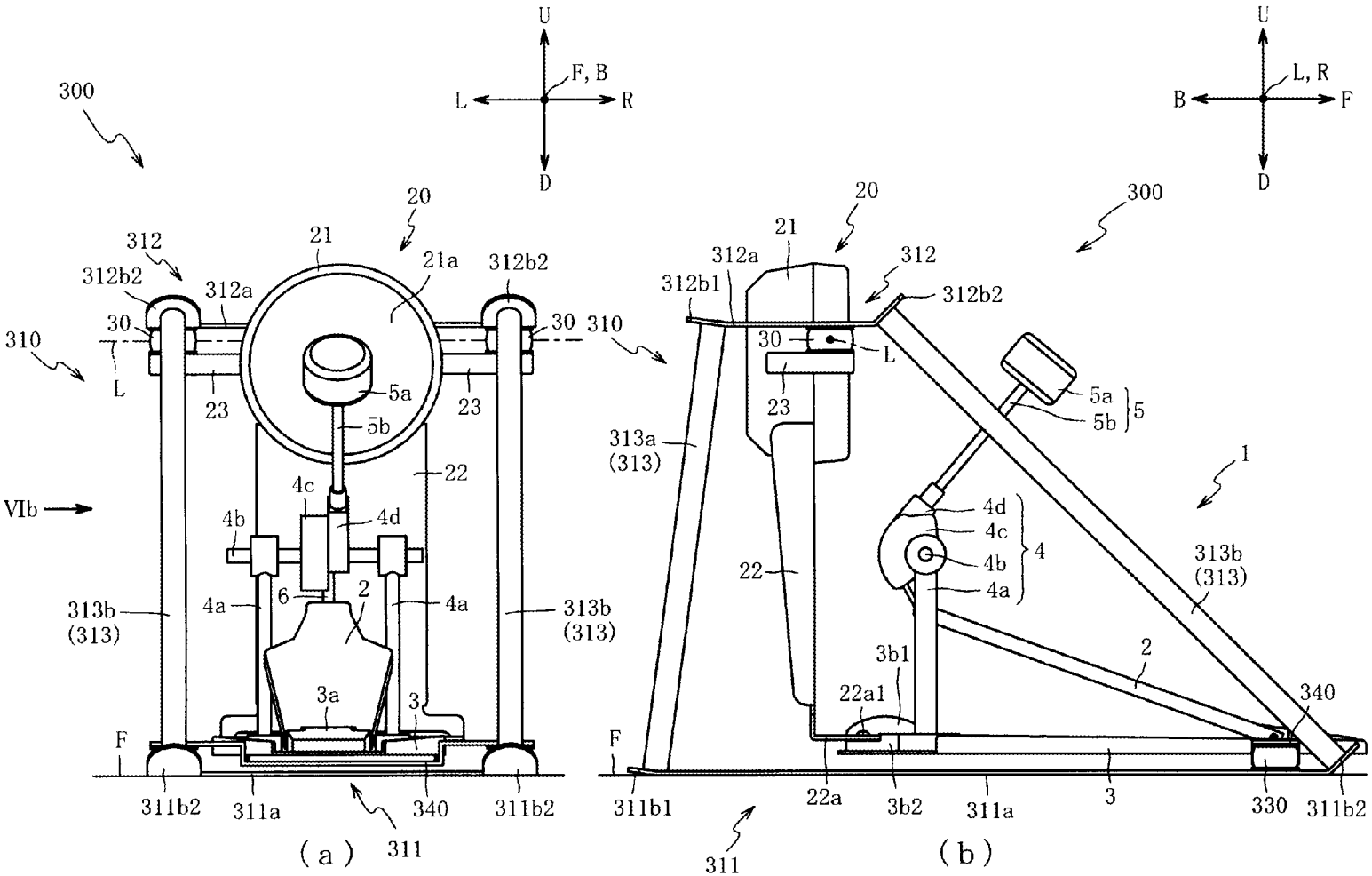
FIG. 6(*a*) is a front view of a support structure for a percussion instrument in accordance with a further embodiment of the invention.

A further embodiment of a support structure 300 for a percussion instrument is described with reference to FIGS. 6(*a*) and 6(*b*). In accordance with embodiments described above, a portion of the pedal device 1 is lifted above the floor surface F. However, in accordance with the embodiment of FIGS. 6(*a*) and 6(*b*), the entire pedal device 1 is lifted above the floor surface F. Components that are identical to components of the embodiments described above are provided with the same reference numbers, and the above descriptions of those components are incorporated herein by reference. FIG. 6(*a*) is a front view of the support structure 300, while FIG. 6(*b*) is a side view of the support structure 300 as viewed in a direction VIb in FIG. 6(*a*).

As shown in FIGS. 6(*a*) and 6(*b*), the support structure 300 includes a support member 310, a percussion instrument member 20, first vibration isolating members 30, a pedal mounting section 340, and second vibration isolating members 330. The support member 310 is configured to be placed on the floor surface F. The percussion instrument member 20 is supported on the support member 310. The first vibration isolating members 30 are provided between the percussion instrument member 20 and the support member 310. The pedal device 1 is mounted on the pedal mounting section 340. The second vibration isolating members 330 are provided between the pedal mounting section 340 and the support member 310.

The support member 310 is formed from metal members that are configured to support the percussion instrument member 20 on the floor surface F, in a state in which the percussion instrument member 20 is lifted above the floor surface F. The support member 310 includes a lower plate 311, an upper plate 312 and leg sections 313. The lower plate 311 is a plate-like member that is configured to be placed on the floor surface F. The upper plate 312 is a plate-like member that is provided above the lower plate 311. The leg sections 313 are rod-like members that connect the upper plate 312 and the lower plate 311.

The lower plate 311 includes a lower base section 311*a*, two rear lower connection sections 311*b*1, and two front lower connection sections 311*b*2. The percussion instrument member 20 is mounted on the lower base section 311*a*, and the lower base section 311*a* is formed as a plate having a channel shape that opens on the front side. The two rear lower connection sections 311*b*1 extend rearward from left and right rear corner sections of the lower base section 311*a*. The two front lower connection sections 311*b*2 extend frontward from left and right front corner sections of the lower base section 311*a*. The lower base section 311*a* is configured to be placed on the floor surface F. The two rear lower connection sections 311*b*1 and the two front lower connection sections 311*b*2 are tilted upwardly with respect to the lower base section 311*a*. The tilt angle of the front lower connection sections 311*b*2 is greater than the tilt angle of the rear lower connection sections 311*b*1.

The upper plate 312 supports the percussion instrument member 20 through the first vibration isolating members 30. The upper plate 312 includes an upper base section 312*a*, two rear upper connection sections 312*b*1, and two front upper connections sections 312*b*2. The upper base section 312*a* is formed as a plate having a channel shape that opens in the front side. The two rear upper connection sections 312*b*1 extend rearward from back, left and right corner sections of the upper base section 312*a*. The two front upper connection sections 312*b*2 extend frontward from front, left and right corner sections of the upper base section 312*a*. The upper base section 312*a* is arranged with the right and left end sections of its lower surface opposing the upper surfaces of end sections of a pair of vibration isolating connection members 23. The upper end face of each of the first vibration isolating members 30 is attached to the lower surface side of the upper base section 312*a*. Further, the lower end face of each of the first vibration isolating members 30 is attached to the upper surface side of each of the left and right outer end sections of the vibration isolating connection members 23. The rear upper connection sections 312*b*1 and the front upper connection sections 312*b*2 are tilted upwardly with respect to the upper base section 312*a*. The tilt angles of the rear upper connection sections 312*b*1 and the front upper connection sections 312*b*2 with respect to the upper base section 312*a* are generally the same as the tilt angles of the rear lower connection sections 311*b*1 and the front lower connection sections 311*b*2 with respect to the lower base section 11*a*, respectively.

The leg sections 313 are configured to support the upper plate 12 at a predetermined height position from the floor surface F. The leg sections 313 include four leg sections in total, at four quarters of the percussion instrument member 20. The leg sections 313 include rear leg sections 313*a* and front leg sections 313*b*. The rear leg sections 313*a* have lower ends connected to the rear lower connection sections 311*b*1 of the lower plate 311. The rear leg sections 313*a* have upper ends connected to the rear upper connection sections 312*b*1 of the upper plate 312. The front leg sections 313*b* have lower ends connected to the front lower connection sections 311*b*2 of the lower plate 311. The front leg sections 313*b* have upper ends connected to the front upper connection sections 312*b*2 of the upper plate 312.

The pedal mounting section 340 retains the entire pedal device 1 in a state lifted above the floor surface F. The pedal mounting section 340 is bridged across and between a pair of second vibration isolating members 330 in a state in which the pedal mounting section 340 is lifted above the floor surface F. The pedal mounting section 340 is provided with a downwardly recessed section in a center portion in the left-to-right direction. The pedal device 1 may be mounted on the recessed section. Accordingly, the pedal device can be restrained from moving in the left-to-right direction on the pedal mounting section 340. The pedal mounting section 340 may be provided with a lock mechanism configured to secure the pedal device 1 to the pedal mounting section 340. For example, a lock mechanism may include a mechanism with two members that fixedly hold the pedal base section 3. Other suitable structures for fixing the pedal device 1 to the pedal mounting section 340 may be used as the lock mechanism.

The second vibration isolating members 330 are configured to attenuate vibration of the pedal mounting section 340. The second vibration isolating members 330 are provided in a pair arranged symmetrically in the left-to-right direction, near the rear end section of the lower base section 311*a* of the lower plate 311. Each of the second vibration isolating members 330 is formed in a cylindrical shape from a rubber-like elastic material. Each of the second vibration isolating members 330 has a lower end face attached to the upper surface side of the lower base section 311*a*. In addition, each of the second vibration isolating members 330 has an upper end face attached to the lower surface side of the pedal mounting section 340. Accordingly, the pedal mounting section 340 is elastically supported on the support member 310. In further embodiments, the pair of second vibration isolating members 330 may be positioned at any suitable location on the upper surface side of the lower base section 311*a*, between the pedal fixing section 22*a* of the percussion instrument member 20 and the front lower connection section 311*b*2 of the lower plate 311 in the front-to-rear direction. The pair of second vibration isolating members 330 may be arranged at a position closer to the front lower connection sections 311*b*2 than to the pedal fixing section 22*a*, for example, to help stably support the pedal mounting section 340 on the support member 310.

The pedal mounting section 340 is elastically supported on the support member 310 through the pair of second vibration isolating members 330, in a state in which the pedal mounting section 340 is lifted above the floor surface F. Therefore, transfer of impacts from the pedal device 1 to the floor surface F caused by a stepping motion on the pedal section 2 can be avoided. Also, vibrations of the pedal mounting section 340 generated by stepping on the pedal section 2 are transferred to the second vibration isolating members 330. Therefore, the vibrations transferred from the pedal mounting section 340 to the second vibration isolating members 330 can be dampened by the vibration isolating effect of the second vibration isolating members 330. Accordingly, vibrations that are transferred from the pedal mounting section 340 to the support member 310 can be reduced. In other words, vibrations of the support member 310 can be reduced. As a result, vibrations that are transferred from the support member 310 to the floor surface F can be reduced.

Also, the second vibration isolating members 330 are provided between the pedal device 1 and the lower base section 311*a* of the support member 310, such that the lower base section 311*a* is placed on the floor surface F. Therefore, compared to a case where vibration isolating members are placed directly on the floor surface F, the support member 310 can be stably supported on the floor surface F. Accordingly, the stability of the support structure 300 for a percussion instrument can be maintained during performance.

Furthermore, the second vibration isolating members 330 are provided between the pedal device 1 and the support member 310, while the pedal device 1 and the pad device 21 are coupled to a pedal connection member 22 that is made of metal. Accordingly, during the period from the moment when the stepping motion on the pedal section 2 is started until the moment when the beating member 5 strikes the striking surface 21*a*, changes in the relative position between the pedal device 1 and the pad device 21 due to elastic deformation of the second vibration isolating members 330 can be avoided. Accordingly, regardless of the force of the stepping motion and the speed of the stepping motion on the pedal section 2, it is possible to suppress changes in the period of time elapsing from the moment when the performer starts stepping on the pedal section 2 until the moment when the beating member 5 strikes the striking surface 21*a*. Accordingly, the performer may more easily beat the striking surface 21*a* stably and at proper timings.

Figure 7:
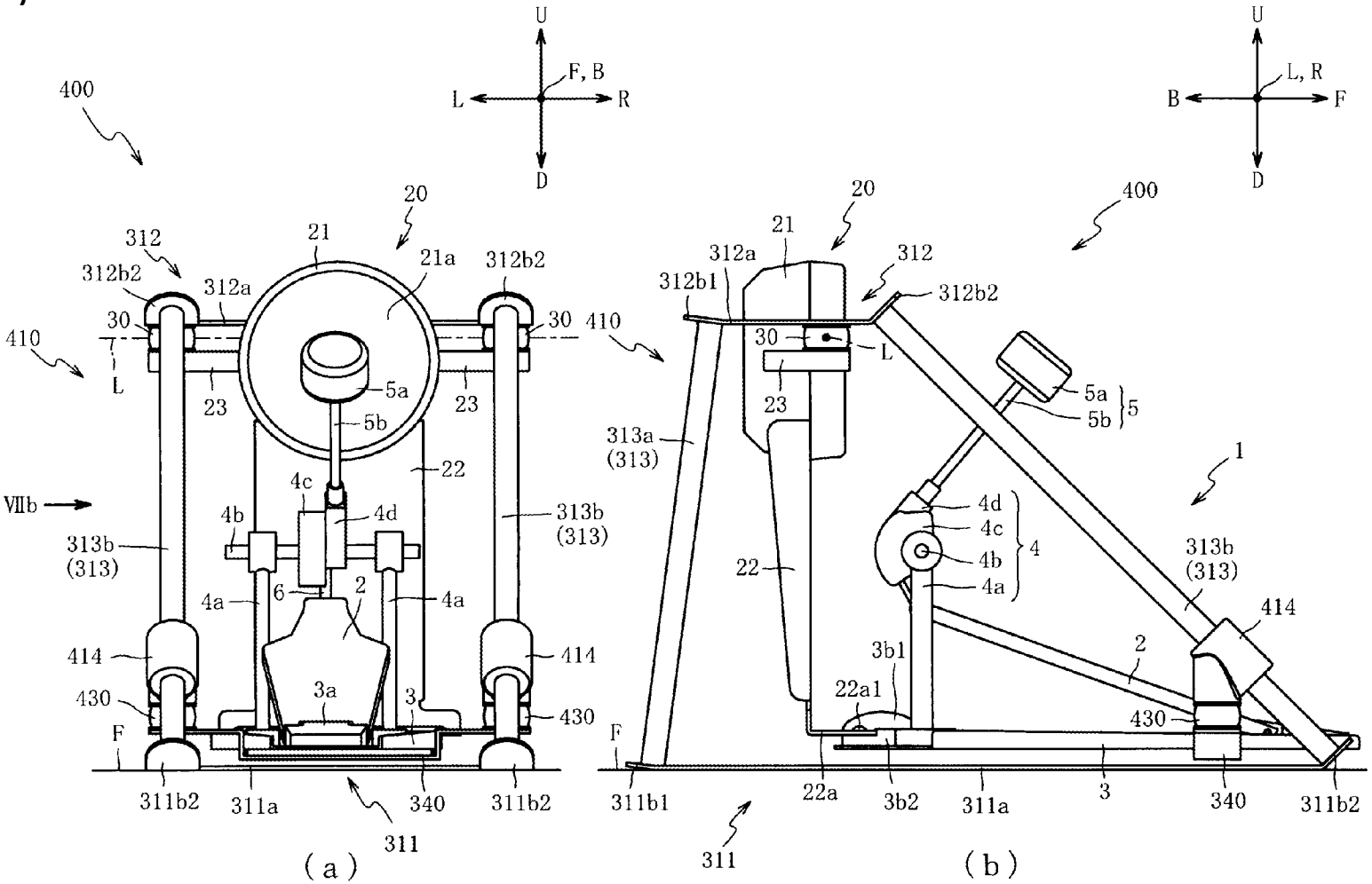
FIG. 7(*a*) is a front view of a support structure for a percussion instrument in accordance with yet a further embodiment of the invention.

A further embodiment of a support structure 400 for a percussion instrument is described with reference to FIGS. 7(*a*) and 7(*b*). In accordance with embodiments described above, a portion of the pedal device 1 is lifted above the floor surface F and, in accordance with further embodiments, the entire pedal device 1 is lifted above the floor surface F. Components that are identical to components of the embodiments described above are provided with the same reference numbers, and the above descriptions of those components are incorporated herein by reference. FIG. 7(*a*) is a front view of the support structure 400, while FIG. 7(*b*) is a side view of the support structure 400 as viewed in a direction VIIb in FIG. 7(*a*).

As shown in FIG. 7(*a*) and FIG. 7(*b*), the support structure 400 includes a support member 410, a percussion instrument member 20, first vibration isolating members 30, a pedal mounting section 340, and second vibration isolating members 430. The support member 410 is configured to be placed on the floor surface F. The percussion instrument member 20 is supported on the support member 410. The first vibration isolating members 30 are provided between the percussion instrument member 20 and the support member 410. The pedal device 1 is mounted on the pedal mounting section 340. The second vibration isolating members 330 are provided between the pedal mounting section 340 and the support member 410.

The support member 410 includes a lower plate 311, an upper plate 312, leg sections 313 and vibration isolator attachment sections 414 attached to the leg sections 313. The second vibration isolating members 430 are attached to the vibration isolator attachment sections 414. The vibration isolator attachment sections 414 are provided in a pair arranged symmetrically near the lower end sections of front leg sections 313*b* that are connected to front lower connection sections 311*b*2 of the lower plate 311.

The second vibration isolating members 430 are configured to attenuate vibrations of the pedal device 1. The second vibration isolating members 430 are provided in a pair, arranged symmetrically in the left-to-right direction, at the end sections of the pedal mounting section 340. Each of the second vibration isolating members 430 is formed in a cylindrical shape from a rubber-like elastic material. Each of the second vibration isolating members 430 has an upper end face attached to the lower surface side of each of the vibration isolator attachment sections 414. Each of the second vibration isolating members 430 has a lower end face attached to the upper surface side of the pedal mounting section 340. Accordingly, the pedal mounting section 340 is elastically supported on the support member 410. In further embodiments, the pair of vibration isolator attachment sections 414 and the pair of second vibration isolating members 430 may be positioned at any suitable location between the pedal fixing section 22*a* of the percussion instrument member 20 and the front lower connection section 311*b*2, at least in the front-to-rear direction. The vibration isolator attachment sections 414 and the second vibration isolating members 430 may be arranged at a position closer to the front lower connection sections 311*b*2 than to the pedal fixing section 22*a*, for example, to help stably support the pedal mounting section 340 on the support member 410.

The pedal mounting section 340 is elastically supported on the support member 410 through the pair of second vibration isolating members 430 in a state in which it is lifted above the floor surface F. Therefore, transfer of impacts from the pedal device 1 to the floor surface F caused by a stepping motion on the pedal section 2 can be avoided. Also, vibrations of the pedal mounting section 340 generated by stepping on the pedal section 2 are transferred to the second vibration isolating members 430. Therefore, the vibrations transferred from the pedal mounting section 340 to the second vibration isolating members 430 can be dampened by the vibration isolating effect of the second vibration isolating members 430. Accordingly, vibrations that are transferred from the pedal mounting section 340 to the support member 410 can be reduced. In other words, vibrations of the support member 410 can be reduced. As a result, vibrations that are transferred from the support member 410 to the floor surface F can be reduced.

Also, the second vibration isolating members 430 are provided between the pedal device 1 and the front leg sections 313*b* of the support member 410, such that the lower base section 311*a* is placed on the floor surface F. Therefore, compared to a case where vibration isolating members are placed directly on the floor surface F, the support member 410 can be stably supported on the floor surface F. Accordingly, the stability of the support structure 400 for a percussion instrument can be maintained during performance.

Furthermore, the second vibration isolating members 430 are provided between the pedal device 1 and the support member 410, and the pedal device 1 and the pad device 21 are coupled to the pedal connection member 22 that is made of metal. Accordingly, during the period from the moment when the stepping motion on the pedal section 2 is started until the moment when the beating member 5 strikes the striking surface 21*a*, changes in the relative position between the pedal device 1 and the pad device 21 due to elastic deformation of the second vibration isolating members 430 can be avoided. Therefore, regardless of the force of the stepping motion and the speed of the stepping motion on the pedal section 2, it is possible to suppress changes in the period of time elapsing from the moment when the performer starts stepping on the pedal section 2 until the moment when the beating member 5 strikes the striking surface 21*a*. Accordingly, the performer may more easily beat the striking surface 21*a* stably and at proper timings.

A further embodiment of a support structure 500 for percussion instruments is described with reference to FIG. 8 and FIG. 9. In accordance with embodiments described above, the percussion instrument member 20 is elastically supported on the support member 10. However, in accordance with the embodiment of FIG. 8 and FIG. 9, the percussion instrument member 20 is elastically supported on a drum stand 550 that can also hold other percussion instruments. Components that are identical to components of the embodiments described above are provided with the same reference numbers, and the above descriptions of those components are incorporated herein by reference.

Figure 8:
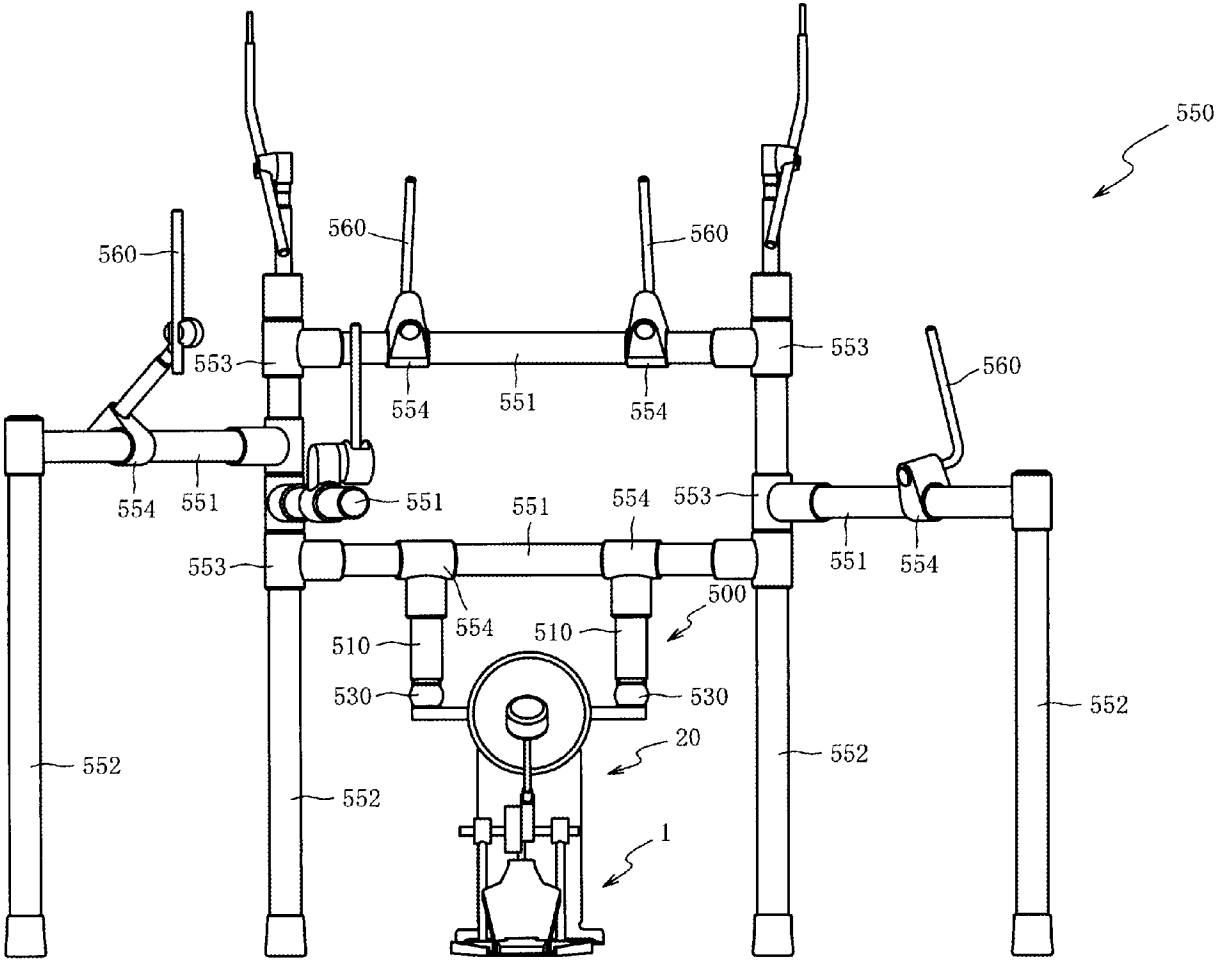
FIG. 8 is a schematic figure of a support structure for a percussion instrument in accordance with yet a further embodiment of the invention with a drum stand.

FIG. 8 is a schematic illustration of an embodiment of the support structure 500 for a percussion instrument, in a state where the support structure 500 is connected to the drum stand 550 and where a pedal device 1 is affixed to the support structure 500. FIG. 9 is a front view of the support structure 500. In FIG. 8 and FIG. 9, coupling holders 553 and connection holders 554 are schematically illustrated.

Figure 9:
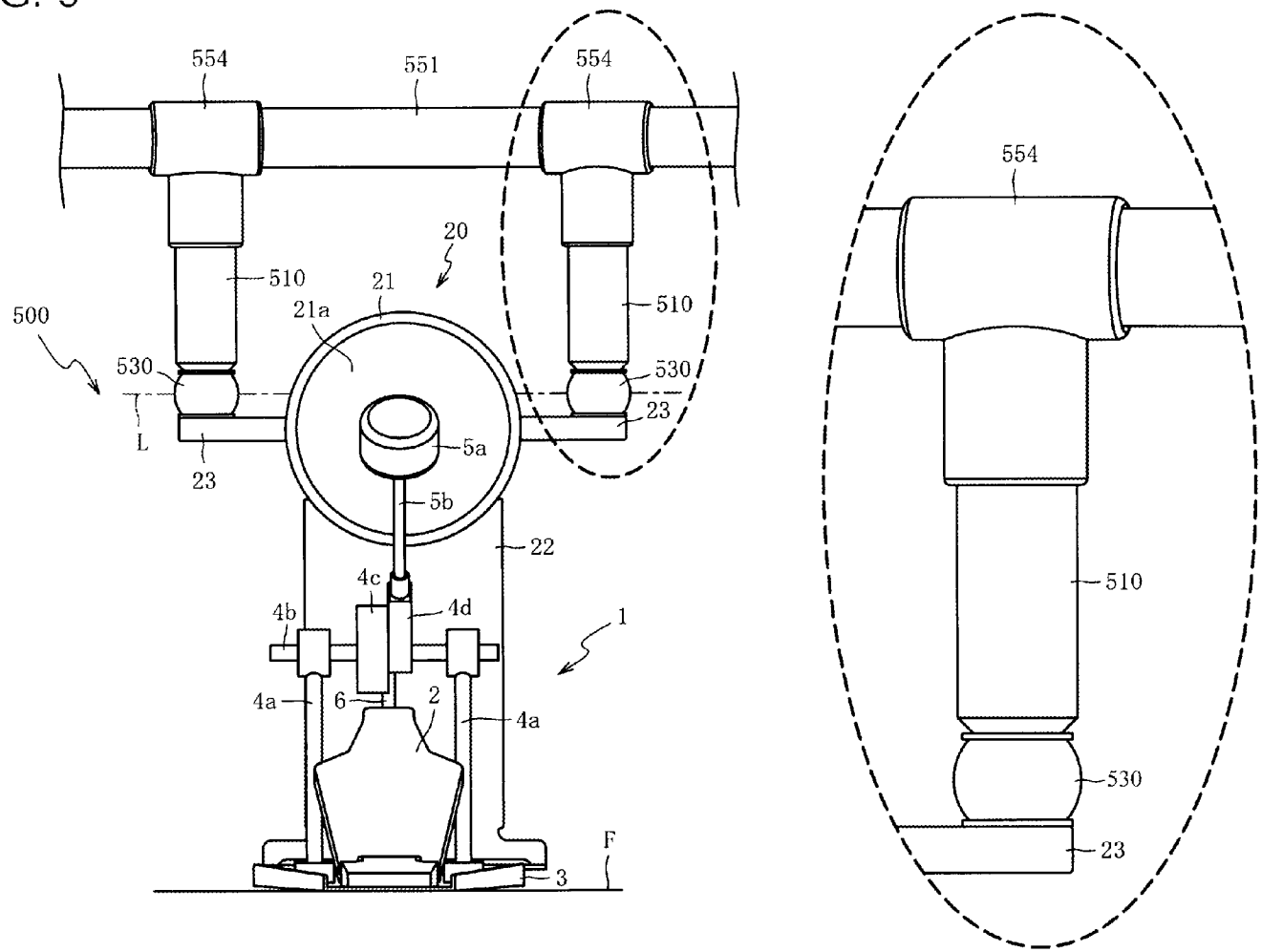
FIG. 9 is a front view of the support structure for a percussion instrument of the embodiment of FIG. 8.

As shown in FIG. 8, the drum stand 550 includes members that support a plurality of musical instruments above the floor surface F (see FIG. 9). The drum stand 550 includes five horizontal pipe members 551, four upstanding pipe members 552, coupling holders 553 and connection holders 554. Each of the horizontal pipe members 551 is arranged in parallel with the floor surface F. Each of the upstanding pipe members 552 is erected upright to the floor surface F. The coupling holders 553 detachably couple the upstanding pipe members 552 to end sections of the horizontal pipe members 551. The connection holders 554 are detachably attached to the outer peripheral surfaces of the horizontal pipe members 551.

Arm members 560 that can be connected to musical instruments are detachably attached to the connection holders 554. The performer may slide the connection holders 554 along the horizontal pipe members 551, or rotate the connection holders 554 about the horizontal pipe members 551, such that plural musical instruments connected to the arm members 560 can be arranged at desired positions for easier performance.

The support structure 500 is configured mainly with support members 510, a percussion instrument member 20, and first vibration isolating members 530. The support members 510 are connected to the drum stand 550. The percussion instrument member 20 is supported on the support members 510. The first vibration isolating members 530 are provided between the percussion instrument member 20 and the support members 510.

As shown in FIG. 9, the support members 510 are configured to support the percussion instrument member 20 on the drum stand 550, and are each formed in a pipe configuration. Each of the support members 510 has one end (on the upper side in FIG. 9) affixed in a freely detachably manner to one of the connection holders 554, and another end with an end face arranged at a position opposite the upper surface of the end section of a respective one of the vibration isolating connection members 23.

The first vibration isolating members 530 are configured to attenuate vibrations of the percussion instrument member 20. The first vibration isolating members 530 are provided in a pair, arranged symmetrically about and diagonally above the pedal fixing section 22*a* of the percussion instrument member 20. Further, the first vibration isolating members 530 are arranged at positions that are equidistant from the pedal fixing section 22*a*. Each of the vibration isolating members 530 is formed from a rubber-like elastic material in a cylindrical shape. Each of the first vibration isolating members 530 has an upper end face attached to a lower end face of the support member 510. Each of the first vibration isolating members 530 has a lower end face attached to an upper surface side of an extended end section of one of the vibration isolating connection members 23 of the percussion instrument member 20. Also, the pair of first vibration isolating members 530 is located generally at the same position, in the front-to-back direction, as the position of the pedal fixing section 22. Further, the pair of first vibration isolating members 530 is located generally at the same height as the height position of the pad device 21.

When the support members 510 are supported on the drum stand 550, the support members 510 and the percussion instrument member 20 in their entireties, as well as one side of the pedal device 1 which is affixed to the percussion instrument member 20 (at the back in a direction normal to the figure surface in FIG. 9), are supported on the drum stand 550 in a state in which they are lifted above the floor surface F. The percussion instrument member 20 is elastically supported on the drum stand 550 through the first vibration isolating members 530 in a state in which the entire percussion instrument member 20 is lifted above the floor surface F. Therefore, vibrations of the percussion instrument member 20 generated when the striking surface 21*a* is beaten by the beating member 5 of the pedal device 1 are transferred to the first vibration isolating members 530. The first vibration isolating members 530 are composed of a rubber-like elastic material. Therefore, the vibration transferred to the first vibration isolating members 530 can be dampened by the vibration isolation effect of the first vibration isolating members 530. Accordingly, vibrations transferred from the percussion instrument member 20 to the drum stand 550 can be reduced. In other words, vibrations of the drum stand 550 can be reduced, such that vibrations transferred from the drum stand 550 to the floor surface F can be reduced.

Further, the pedal device 1 is elastically supported on the drum stand 550 through the first vibration isolating members 530 in a state in which the side of the pedal device 1 that is affixed to the percussion instrument member 20 is lifted above the floor surface F. Therefore, transfer of impacts from the pedal device 1 to the floor surface F which is caused by the stepping motion can be reduced. Also, the pedal device 1 is affixed to the pedal fixing section 22*a* (see FIG. 4), and is elastically supported on the drum stand 550 through the pedal connection member 22. Therefore, vibrations transferred from the pedal device 1 to the percussion instrument member 20 can be dampened by the vibration isolating effect of the first vibration isolating members 530. Accordingly, transfer of vibrations from the pedal device 1 to the floor surface F can be suppressed.

Also, the support members 510 are connected to the drum stand 550 that holds other percussion instruments above the floor surface F. Therefore, an additional space on the floor for the support members, other than the space for placing the drum stand 550, can be unnecessary. Also, as compared to the case where support members are placed on the floor surface, the structure of the support members 510 can be simplified, such that the cost for manufacturing the support members 510 can be reduced.

Moreover, vibration transferred from the percussion instrument member 20 to the horizontal pipe members 551 is transferred to the floor surface F through the coupling holders 553 and the upstanding pipe members 552. Therefore, a longer vibration transfer path can be formed from the percussion instrument member 20 to the floor surface F, which can help to further reduce the transfer of vibrations from the percussion instrument member 20 to the floor surface F.

The coupling holders 553 and the connection holders 554 may be formed from synthetic resin, such that, compared to the case in which they are formed from metal, vibrations transferred to the coupling holders 553 and the connection holders 554 would more readily be dampened. Therefore, with embodiments using coupling holders 553 and the connection holders 554 formed from synthetic resin, vibrations transferred from the percussion instrument member 20 to the floor surface F can be further reduced.

The invention has been described above based on example embodiments, but the invention need not be limited in any particular manner to the embodiments described above, and it can be readily understood that various improvements and changes can be made without departing from the subject matter of the invention.

For example, in embodiments described above, the first vibration isolating members 30, 230 or 530 are attached to the outer end portions in the left-to-right direction of the pair of vibration isolating connection members 23 of the percussion instrument member 20. However, in further embodiments of the invention, the first vibration isolating members 30, 230 or 530 may be attached to positions closer to the pad device 21 than to the outer end portions in the left-to-right direction of the pair of vibration isolating connection members 23, and symmetrically provided in a pair, at positions equidistant from the pedal fixing section 22*a*.

Further, in embodiments described above, the percussion instrument member 20 is equipped with a pair of vibration isolating connection members 23, and the first vibration isolating members 30, 230 or 530 are attached to the pair of vibration isolating connection members 23. However, in further embodiments of the invention, the first vibration isolating members 30, 230 or 530 may be attached to the pad device of the percussion instrument member 20. As a result, the pair of vibration isolating connection members 23 may be omitted and, therefore, the cost of parts can be avoided. Also, in this further embodiment, a single first vibration isolating member 30, 230 or 530 may be provided at a central portion of the pad device 21 in the left-to-right direction. Accordingly, the first vibration isolating members 30, 230 or 530 need not to be provided in a pair, such that the cost of those parts can be reduced. Moreover, if the single first vibration isolating member 30, 230 or 530 is provided at a central portion of the pad device 21 in the left-to-right direction, a greater portion of the dimension of the first vibration isolating member 30, 230 or 530 in the left-to-right direction may be employed, such that the percussion instrument member 20 can be stably retained.

Also, in embodiments described above, the pair of first vibration isolating members 30, 230 or 530 and the pair of second vibration isolating members 330 or 430 are arranged on the left and on the right, respectively. However, in further embodiments of the invention, the first vibration isolating members 30, 230 or 530, and/or the second vibration isolating members 330 or 430 may be arranged on the left and on the right, respectively, in two or more pairs. As a result, the vibration isolating effect can be improved further with multiple pairs of the first vibration isolating members 30, 230 or 530, or the pairs of the second vibration isolating members 330 or 430.

Moreover, in embodiments described above, the first vibration isolating members 30, 230 or 530 are provided in a pair arranged symmetrically with respect to the pedal fixing section 22*a*, and the pair of the first vibration isolating members 30, 230 or 530 on the left and on the right are arranged at positions equidistant from the pedal fixing section 22*a*. However, in further embodiments of the invention, the first vibration isolating members 30, 230 or 530 in a pair on the left and on the right may be provided such that each of them has the same rotational momentum about the center of gravity of the percussion instrument member 20. Accordingly, the stability of the support structure 100, 200, 300, 400 and 500 during performance of the musical instrument can be maintained.

Further, in embodiments described above, the pad device 21 is an electronic percussion instrument in which a sensor (not shown) for detecting vibrations of the striking surface 21*a* is provided inside of the pad device 21. However, in further embodiments of the invention, the pad device 21 may be, for example, an acoustic pad or a practice pad that does not have a sensor for detecting vibration of the striking surface 21*a*. The illustrated embodiments show examples of a pad device 21 in the form of a practice pad that has no sensor and that has a striking surface composed of a rubber or a mesh-like material to suppress striking sounds. Further embodiments of the electronic percussion instrument include a pad device in the form of a practice pad with no sensor located within the pad as described above, but that further includes or employs a pedal device having a sensor. The sensor may be located within the head member of the beating member (or at other suitable locations) on the pedal device, for detecting vibrations of the head member generated when the head member of the beating member strikes the striking surface of the pad device.

The invention claimed is:

1. A support structure for a percussion instrument, the support structure comprising:

a percussion instrument member having a pad device with a striking surface configured to be performed by a performer making a stepping motion on a pedal device to pivotally move a beating member to strike the striking surface in association with the stepping motion;

a support member that supports the percussion instrument member in a state in which the entire percussion instrument member is lifted above a floor surface, and supports the pedal device in a state in which at least a portion of the pedal device is lifted above the floor surface; and at least one first vibration isolating member provided between the percussion instrument member and the support member, the at least one first vibration isolating member being composed of an elastic material;

wherein the percussion instrument member has a coupling member coupled to the pad device and having a pedal fixing section spaced a predetermined distance from the pad device, the pedal fixing section for holding the pedal device; and wherein the percussion instrument member is elastically supported on the support member through the at least one first vibration isolating member.

2. A support structure for a percussion instrument according to claim 1, wherein the first vibration isolating member is disposed nearer to the pad device than to the pedal fixing section.

3. A support structure for a percussion instrument according to claim 1, wherein the first vibration isolating member is disposed vertically above the pedal fixing section.

4. A support structure for a percussion instrument according to claim 2, wherein the first vibration isolating member is disposed vertically above the pedal fixing section.

5. A support structure for a percussion instrument according to claim 1, further comprising:

a pedal mounting section for mounting the pedal device thereon; and at least one second vibration isolating member provided between the pedal mounting section and the support member, the at least one second vibration isolating member being composed of an elastic material;

wherein the pedal mounting section is elastically supported on the support member in a state in which the entire pedal mounting section is lifted from the floor surface when the pedal device is mounted on the pedal mounting section.

6. A support structure for a percussion instrument according to claim 1, further comprising:

a drum stand having a plurality of pipe-like members and holders for coupling the plurality of pipe-like members together, each pipe-like member being formed in a tubular shape, the plurality of pipe-like members for holding a plurality of musical instruments, and a portion of the plurality of pipe-like members being configured to be placed on the floor surface;

wherein the support member is connected to the drum stand; and wherein the support member and the percussion instrument member are supported on the drum stand in a state in which the entire support member and the entire percussion instrument member are lifted above the floor surface.

7. A support structure for a percussion instrument according to claim 1, wherein the percussion instrument member is an electronic percussion instrument having a sensor that detects striking of the striking surface of the pad device.

8. A support structure for supporting a percussion instrument, the support structure comprising:

a support member configured to rest on a floor surface and support a percussion instrument member over the floor surface in a state in which the entire percussion instrument member is lifted above the floor surface, and to support a pedal device in a state in which at least a portion of the pedal device is lifted above the floor surface;

at least one first vibration isolating member coupled to the support member in a position between the percussion instrument member and the support member when the support member supports the percussion instrument member, the at least one first vibration isolating member being composed of an elastic material; and a pedal connection member having a pedal holding section for holding the pedal device, the pedal connection member being coupled to the percussion instrument member.

9. A support structure for a percussion instrument according to claim 8, further comprising:

a percussion instrument member comprising a pad device having a striking surface for receiving strikes, and a vibration isolating connection structure coupled to the pad device;

the support member comprising an upper support element;

wherein the at least one first vibration isolating member is coupled between and to the vibration isolating connection structure and the upper support element, to elastically support the vibration isolating connection structure and the percussion instrument member relative to the upper support element.

10. A support structure for a percussion instrument according to claim 9, wherein the upper support member comprises a plate-like member arranged vertically above the vibration isolating connection structure.

11. A support structure for a percussion instrument according to claim 9, wherein the pedal holding section is supported above the floor surface when the support member rests on the floor surface.

12. A support structure for a percussion instrument according to claim 9, wherein the pedal holding section has one end coupled to the pedal connection member and a second end configured to be coupled to the pedal device.

13. A support structure for a percussion instrument according to claim 12, wherein the support structure further comprises a base member configured to be placed on a floor surface when the support member rests on the floor surface, a pedal mounting section arranged to cooperate with the pedal holding section for supporting the pedal device in a state in which the pedal device is lifted above the floor surface when the base member is placed on the floor surface.

14. A support structure for a percussion instrument according to claim 13, wherein the support structure further comprises at least one second vibration isolating member arranged between the base member and the pedal mounting section.

15. A method of supporting a percussion instrument, the method comprising:

configuring a support member to rest on a floor surface;

supporting a percussion instrument member on the support member over the floor surface in a state in which the entire percussion instrument member is lifted above the floor surface;

supporting a pedal device on the support member in a state in which at least a portion of the pedal device is lifted above the floor surface;

wherein supporting the percussion instrument member comprises coupling at least one first vibration isolating member to the support member in a position between the percussion instrument member and the support member, the at least one first vibration isolating member being composed of an elastic material; and wherein supporting the pedal device comprises supporting a pedal connection member on the percussion instrument member, the pedal connection member having a pedal holding section holding the pedal device.

16. A method according to claim 15, wherein supporting the percussion instrument further comprises:

coupling a vibration isolating connection structure to the percussion instrument member;

providing the support member with an upper support element; and coupling the at least one first vibration isolating member between and to the vibration isolating connection structure and the upper support element, to elastically support the vibration isolating connection structure and the percussion instrument member relative to the upper support element.

17. A method according to claim 15, wherein the upper support member comprises a plate-like member arranged vertically above the vibration isolating connection structure.

18. A method according to claim 15, further comprising supporting the pedal connection member on the percussion instrument member such that the pedal holding section is held above the floor surface when the support member rests on the floor surface.

19. A method according to claim 15, further comprising providing the support structure with a base member for resting on the floor surface and a pedal mounting section for supporting a portion of the pedal device.

20. A method according to claim 15, further comprising coupling at least one second vibration isolating member to the base member, between the pedal mounting section and the base member.

21. A support structure for a percussion instrument according to claim 8, wherein the pedal connection member extends downward from the percussion instrument member, without contacting the floor surface when the support member rests on the floor surface.

22. A support structure for a percussion instrument according to claim 8, wherein the pedal connection member is supported by the percussion instrument member above and separated from the floor surface, when the support member rests on the floor surface.

23. A support structure for a percussion instrument according to claim 8, wherein the pedal connection member connects to the percussion instrument member, with no portion of the support member being located between the pedal connection member and the percussion instrument member.

24. A support structure for a percussion instrument according to claim 8, wherein the pedal connection member has one end coupled to the percussion instrument and a second end having the pedal holding section supported above the floor surface when the support member rests on the floor surface, the second end being separated from the support member.

* * * * *